United States Patent [19]

Reiling et al.

[11] Patent Number: 4,909,117

[45] Date of Patent: Mar. 20, 1990

[54] PORTABLE DRUM SOUND SIMULATOR

[75] Inventors: Victor G. Reiling, West Cornwell; Bryan I. Dean, Torrington, both of Conn.

[73] Assignee: Nasta Industries, Inc., New York, N.Y.

[21] Appl. No.: 333,879

[22] Filed: Mar. 31, 1989

Related U.S. Application Data

[63] Continuation of Ser. No. 149,656, Jan. 28, 1988, abandoned.

[51] Int. Cl.[4] ..... G10H 1/057; G10H 5/00

[52] U.S. Cl. ..... 84/738; 84/422.4; 84/DIG. 12

[58] Field of Search ..... 84/1.13, 1.26, DIG. 12, 84/1.03, 1.28, 422 R, 422 S, 1.01, 422.4; 200/61.48, 61.49, 61.51; 307/268, 529; 331/78, 145, 172, 182

[56] References Cited

U.S. PATENT DOCUMENTS

| | | | |
|---|---|---|---|
| 2,655,071 | 10/1953 | Levay . | |
| 3,053,949 | 9/1962 | Johnson | 200/61.49 |
| 3,198,872 | 8/1965 | Finkenbeiner . | |
| 3,509,264 | 4/1970 | Green . | |
| 3,634,595 | 1/1972 | Pasquali . | |
| 3,731,022 | 5/1973 | Loftus | 200/61.49 |
| 4,178,823 | 12/1979 | McCoskey et al. | 84/1.01 |
| 4,341,140 | 7/1982 | Ishida . | |
| 4,418,598 | 12/1983 | Ulynas | 84/DIG. 12 X |
| 4,753,146 | 6/1988 | Seiler | 84/DIG. 12 X |
| 4,776,253 | 10/1988 | Downes | 84/1.01 |

FOREIGN PATENT DOCUMENTS

| | | | |
|---|---|---|---|
| 0264782 | 4/1988 | European Pat. Off. . | |
| 2183076 | 5/1987 | United Kingdom | 84/422 S |

OTHER PUBLICATIONS

Simonton, Jr., "Build a Portable Synthesizer," Radio-Electronics, vol. 47, No. 1, pp. 46–48, 82–85, Jan. 1976.

*Consumer Reports*, Nov., 1988, p. 684.

*The Encyclopedia of Electronic Circuits*, TAB Books Inc., Blue Ridge Summit, 1965, pp. 467–468.

*Primary Examiner*—Stanley J. Witkowski

*Attorney, Agent, or Firm*—Lackenbach Siegel Marzullo & Aronson

[57] ABSTRACT

A portable drum sound simulator, especially suitable for carrying by the user, includes a pair of drumsticks containing electrical switches which are actuated by change in motion. The switches are connected to a trigger circuit which initiates operation of a drum sound generator every time a switch is closed. The drum sound signal after amplification drives a loudspeaker. The circuits and loudspeaker are all contained in a small portable case. In an alternative embodiment, a radio receiver is included, whereby the simulator is selectively used as an independent radio, an independent drum sound simulator, or combining the radio signal with the operator produced drum signals.

10 Claims, 5 Drawing Sheets

Vcc
GND
RADIO
(TUNER/AMPLIFIER)
80
70, 72
74
82
84
85
86
88
16
62
63
76
28
36
34
Q1
Q2
Q3
Q4
Q5
Q6
Q7
Q8
Q9
Q10
R1
R2
R3
R4
R5
R6
R7
R8
R9
R10
R11
R12
R13
R14
R15
R16
R17
R18
C1
C2
C3
C4
C5
C6
C7
C8
C9
C10
C11
C12
C13
C14
A
B
C

PORTABLE DRUM SOUND SIMULATOR

This application is a continuation of application Ser. No. 149,656, filed Jan. 28, 1988 abandoned.

BACKGROUND OF THE INVENTION

This invention relates generally to a drum sound simulator of the type which electronically produces a drum-like sound each time a drumstick connected to the simulator taps against a surface, and more particularly to a drum sound simulator which is portable and operates without need for an actual drum. Drum beats are part of most music, from very primitive native music to sophisticated classical compositions and drums are often played in solo passages as part of an overall orchestral or modern music performance.

Electronic keyboards are now available which can produce sounds claimed to be similar to every known type of instrument including classical instruments and more popular devices. New sounds are synthesized. These keyboards, while transportable and perhaps considered in a sense to be portable because they can be readily moved, are not in constructions which an individual would carry during a performance. The keyboards presently available generally attempt to suggest a piano keyboard and the operator or user thereof sits at a bench or chair as would a performer at a paino. A prior art device is known in U.S. Pat. No. 2,655,071 wherein a drum sound is produced electronically whenever a performer taps on a modified drum with his drumsticks to complete a circuit between stick and drum. Because it is necessary to transport both the drum and the associated electronics, this device is not portable in the sense described, wherein the performer is completely free of his surroundings and can produce drum sounds without need for a drum, or as described more fully hereinafter, without need for a hard surface. The keyboards do not include circuits for interaction with other sound sources.

What is needed is a drum sound simulator which is entirely portable, can be carried by the performer and allows both solo performance and accompaniment of available audio musical sounds from broadcast or recorded sources.

SUMMARY OF THE INVENTION

Generally speaking, in accordance with the invention, a portable drum sound simulator, especially suitable for carrying by the performer independently of its surroundings, is provided. This simulator comprises a pair of drumsticks containing therein electrical switches which are actuated by sudden change in motion or acceleration of the drumsticks, as when the moving sticks strike against a surface or when a person holding the sticks moves them and rapidly stops them or reverses their direction of movement. The switches within the drumsticks are connected to a trigger circuit which initiates operation of a drum sound generator every time one or both of the switches in the respective sticks is closed as described above. The drum sound signal is inputted to an audio amplifier which drives a loudspeaker producing an audible sound, similar to that produced by an actual drum. The trigger circuit, drum sound generator, audio amplifier and loudspeaker are all contained in a small enclosure or case which provides access to an ON/OFF volume control knob and allows for connection by wires between the drumsticks and the circuits within the enclosure. A battery within the enclosure activates the circuits and makes the unit entirely self-contained and completely portable.

In an alternative embodiment, a radio receiver is also included within the enclosure, whereby it is possible to use the device as an independent radio, an independent drum sound simulator as described above, or a device which combines the radio signal with the operator produced drum signals such that the operator can accompany on the drums, by simulation, the music played on the radio. An externally operated switch allows selection between these three modes.

Accordingly, it is an object of this invention to provide an improved drum sound simulator which is entirely portable and independent of its surroundings, being carriable by the user in performance.

Another object of this invention is to provide an improved drum simulator which includes drumsticks similar to actual drumsticks and operates without need for an actual drum.

A further object of this invention is to provide an improved drum sound simulator which serves as either a simulated drum, a radio, or a drum accompanying a broadcast or recorded performance.

Still another object of this invention is to provide an improved drum simulator, where the action of drumsticks initiates the simulated drum sounds.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
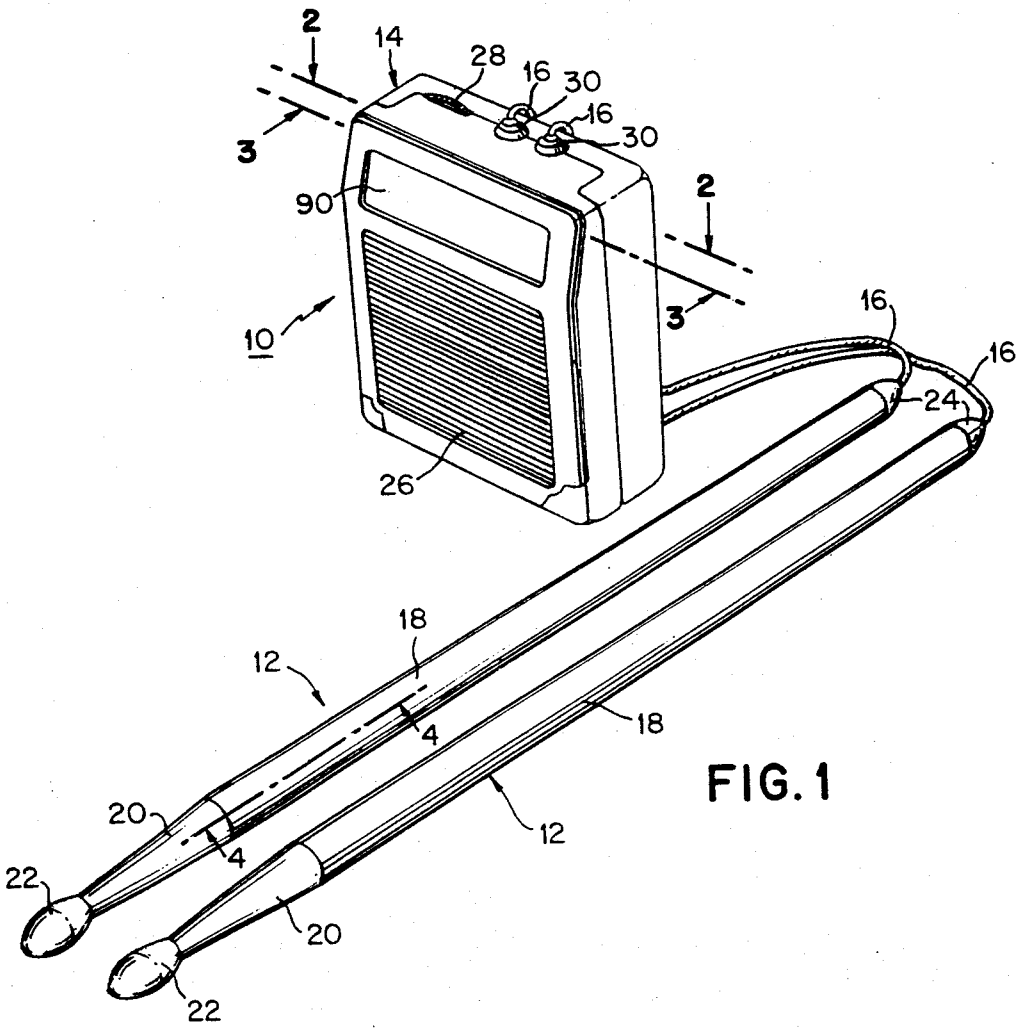
FIG. 1 is a perspective view of a portable drum sound simulator in accordance with the invention.
Figure 3:
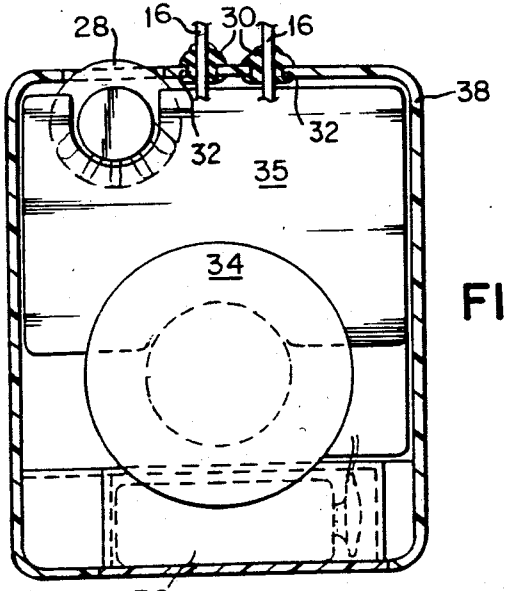
FIG. 3 is a front sectional view taken along the line 3—3 of FIG. 1.
Figure 2:
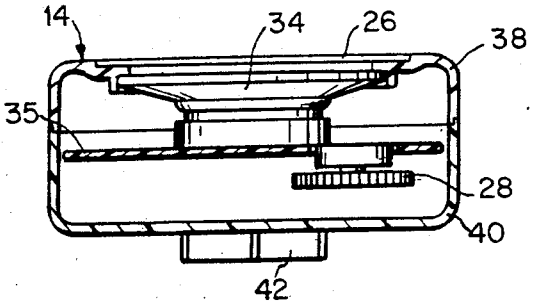
FIG. 2 is a top sectional view taken along the line 2—2 of FIG. 1.

With reference to the Figures, the drum sound simulator of this invention includes two drumsticks 12 connected to an enclosure or case 14 by means of individual leads 16 or cords. The drumsticks 12 are similar in size and appearance to authentic drumsticks. Each stick 12 comprises a rigid plastic tube 18 with a soft plastic tip 20 to cover the striking end of the stick. The soft plastic tip 20 extends from the striking end 22 approximately 25% of the total stick length. At the handle end of the stick 12, a soft plastic end cap 24 restrains the lead or cord 16 where it exits from the stick.

The enclosure or case 14 includes a loudspeaker grill cover 26, an ON/OFF switch combined with a volume control 28, and a pair of soft plastic rings 30, where the cords 16 enter the enclosure 14 through openings 32 in the enclosure 14.

Inside the enclosure 14 are a loudspeaker 34 mounted to output sound through the grill 26, the ON/OFF-/volume control 28 of a conventional type including a partially visible knob, rheostat and built-in switch. Also included within the enclosure 14 are a printed circuit board 35 for the electronic circuits of the drum sound simulator in accordance with the invention, and a battery 36 which powers the electronic circuits. The enclosure 14 is in two halves, namely a front 38 and rear 40. A belt clip 42 is fixedly attached to the rear half 40. This clip slips over the belt of a person carrying the simulator in accordance with the invention so that the user's hands are entirely free for manipulation of the drumsticks 12.

The dimensions of the enclosure 14 accommodate portability, and minimum size is only limited by the electronic components which are available for packaging in the enclosure. Thus, an enclosure 14 which is readily held in the palm of the hand, can be produced. However, increased battery holding capacity and a larger loudspeaker which enhances sound quality, can be used in larger versions which are still entirely portable in the sense that they can be attached to the body of the user. For examples, the belt clip 42, as illustrated, or shoulder straps, etc., which still leave the user's hands free to manipulate the drum- sticks 12, can also be used. Also, an external handle or straps (not shown) can be provided on the enclosure 14 or on a lightweight carrying case for the enclosure to enable portability. When not carried, the device is easily placed on any surface so that the user may freely manipulate both drumsticks. As described hereinafter, operation with a single drumstick is also inherent in the device. As is conventional with portable radios, cassette players, hand and desk calculators, etc. etc., the drum sound simulator in accordance with the invention can be adapted for use with an external source of power in addition to its inherent electric capability provided by the internal battery 36. Jacks (not shown) can be provided to allow use of earplugs or earphones.

Figure 4:
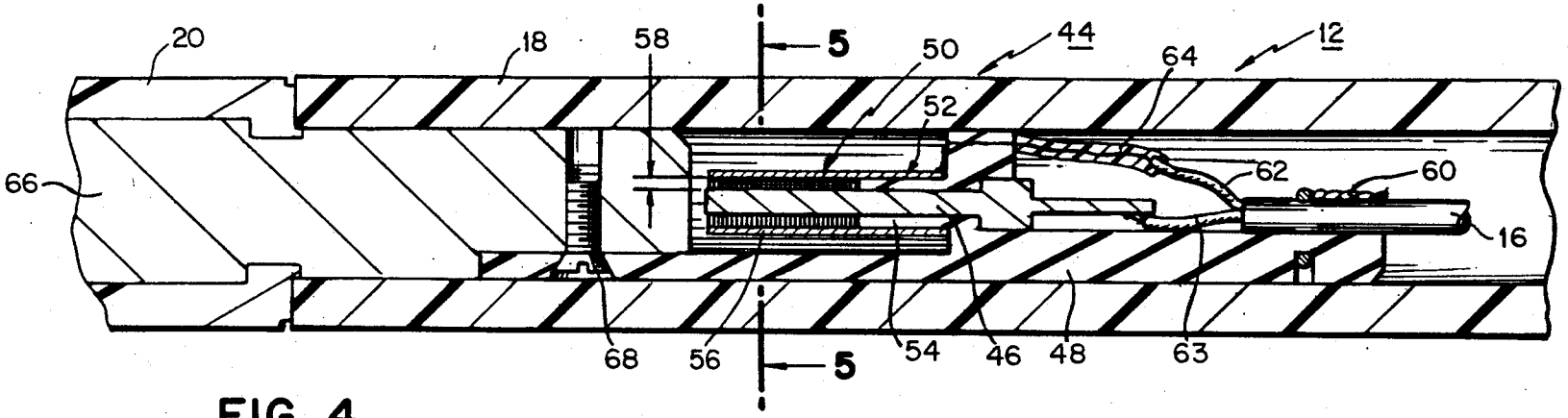
FIG. 4 is a sectional view of the drumstick taken along the line 4—4 of FIG. 1.
Figure 5:
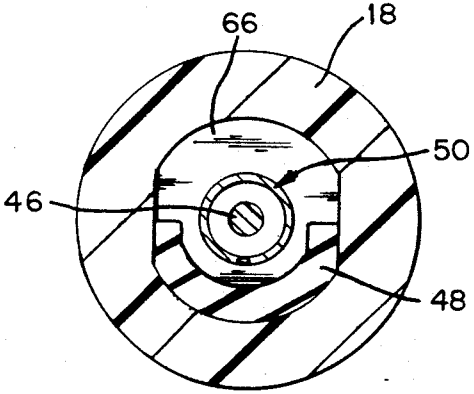
FIG. 5 is a view taken along the line 5—5 of FIG. 4.

As best illustrated in FIGS. 4 and 5, an inertia switch 44 mounts within the rigid tube 18 of each drumstick 12. The switch 44 includes an electrically conductive metal shaft 46 mounted in a non-conductive holder 48 and concentrically surrounded by a circular coil spring 50. The spring 50 is mounted at one end 52 around a protruding portion 54 of the holder 48. The spring 50 is coiled concentrically with the shaft 46 and is suspended as a cantilever beam which allows the other or free end 56 of the spring 50 to swing or oscillate about its fixed end 52 as described more fully hereinafter. The resilience of the cantilevered spring 50 depends on the spring wire from which it is fabricated and the closeness of the turns. As illustrated, the turns are adjacent to one another and are sufficiently stiff such that in a static state, the switch spring 50 maintains a substantially uniform gap 58 between the spring 50 and the shaft 46. The magnitude of the gap is determined by the circumference of the protruding portion 54 of the holder 48.

The external cord 16 passes through the hollow tube 18 and is anchored to the holder 48 by a metal wire tie 60. Two electrical wires 62, 63 extend from the cord 16. The wire 63 connects to a rear extension of the metal shaft 46, whereas the wire 62 connects to the spring coil 50 by way of a hollow insulating tube 64. A rigid core 66 fills the soft tip 20 and extends between the tip 20 and the tube 18 to provide a basically rigid structure covered by the soft tip 20. A machine screw 68 fixedly connects the holder 48 to the core 66. The core 66 is a press fit within the tube 18. In alternative embodiments, for examples, adhesives may be used for this connection or a screw through the tube 18 can engage the core 66.

The spring 50 maintains its relationship with the metal shaft 46, that is, spaced apart, so long as the stick 12 remains in a static condition or is moving without acceleration or deceleration. When the stick 12 is moved briskly, that is, stick motion is abruptly changed, for examples, as in striking a surface as one would strike a drum in a conventional manner, or in "striking" the air by abruptly interrupting motion in one direction of the stick 12 with a motion in the opposite direction, the switch 44 closes. In particular, with these sudden changes in motion, the momentum of the spring causes the spring coils to separate slightly resulting in an elastic deflection or swinging of the free end 56 of the spring 50 toward the metal shaft 46. When the spring 50 and shaft 46 make contact, an electrical circuit is completed through the switch 44. Contact is maintained only momentarily before the spring 50 resumes its original spaced apart position relative to the shaft 46, whereby continuity of the switch is opened. Individual or successive strikes with the stick 12 result in any number of momentary switch contacts as desired by the user. Each drumstick 12 contains such a switch 44 to which the circuits respond.

The spring 50 has a stiffness which prevents unintended drum sounds for light motions such as simply picking up or carrying the sticks. Spring stiffness also operates to damp spring oscillation and prevent output of plural drum sounds for single drum "strokes".

Figure 6:
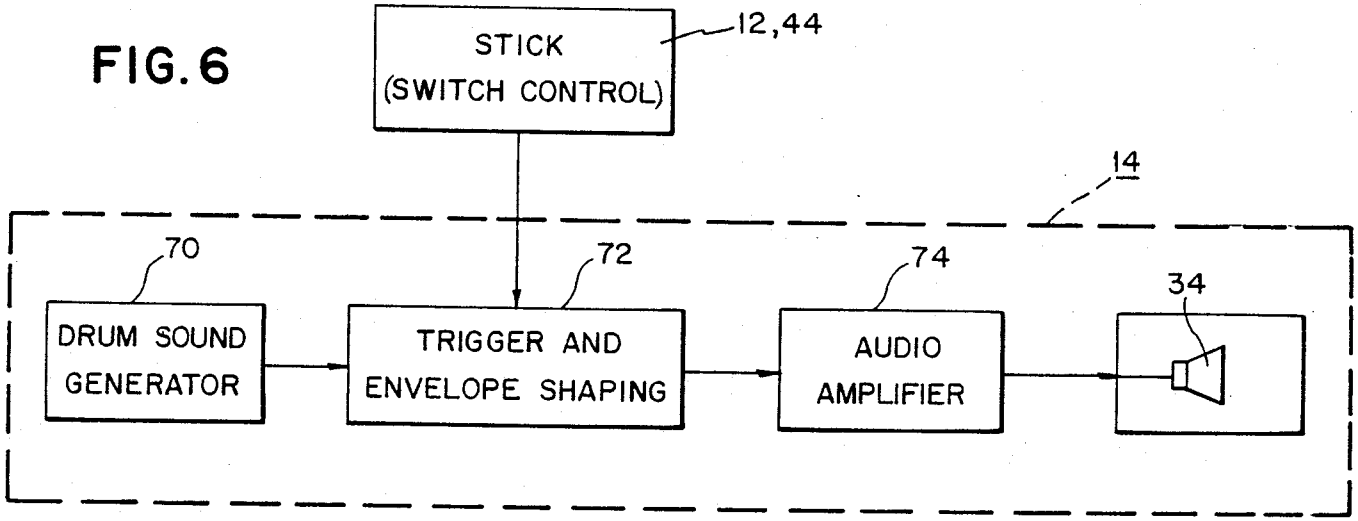
FIG. 6 is a functional block diagram of the portable drum sound simulator of FIG. 1.

As illustrated in FIG. 6, the drumstick 12 in combination with its internal switch 44, provides a trigger signal upon closing the switch 44. The trigger signal initiates operation of a drum sound generator 70 having an output which is shaped by a trigger and envelope shaping circuit 72 and fed to an audio amplifier 74 whose output drives a loudspeaker 34. Each closing of a switch 44 outputs a single drum sound from the speaker 34. The switches 44 are electrically connected in parallel.

Figures 7, 10:
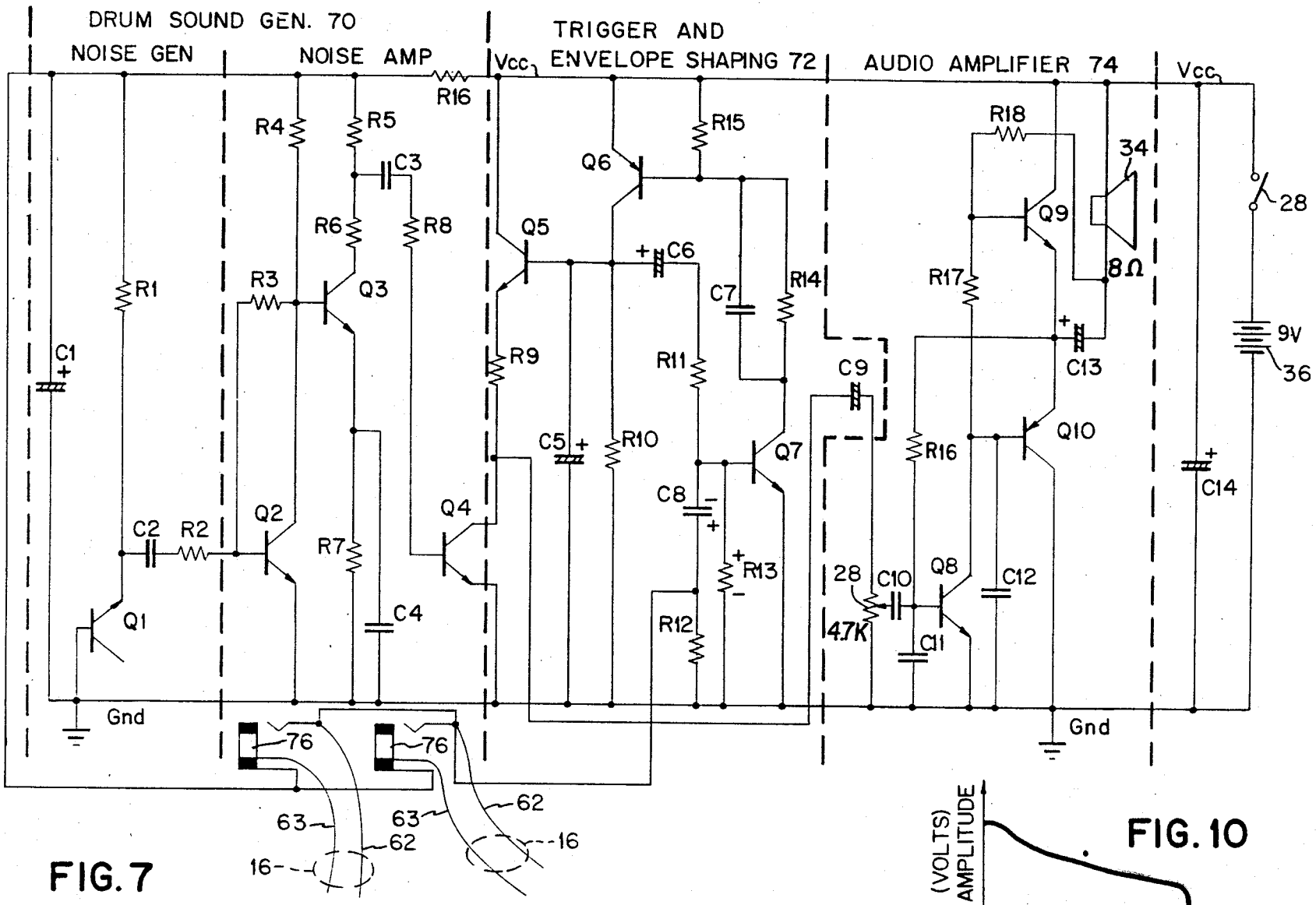
FIG. 7 is an electrical circuit schematic of the drum sound simulator, less drumsticks, of FIG. 1.
FIG. 10 illustrates an audio signal waveform from the drum sound generator in the circuits of FIGS. 7 and 8.

FIG. 7 is a circuit for analog operation in performing the functions illustrated in FIG. 6. This circuit includes the battery 36, outputting a voltage identified as $V_{cc}$ at its positive terminal and with its negative terminal connected to ground. Across the battery 36, with the intervening ON/OFF switch 28, is filter capacitor C14. Also connected to $V_{cc}$ are one end of a resistor R15, the emitter of PNP (or P-type) transistor Q6, collector of NPN (or N-type) transistor Q5, and one end of resistor R16. The other end of resistor R15 connects to the base of the transistor Q6 and to one end of capacitor C7 and resistor R14. The other ends of capacitor C7 and R14 are connected to the collector of transistor Q7, having its emitter connected to ground. The collector of transistor Q6 is connected to the base of transistor Q5 and to one end of capacitor C6, capacitor C5, and resistor R10. The other end of capacitor C5 and resistor R10 are connected to ground and the other end of capacitor C6 is connected to resistor R11. The other end of resistor R11 is connected to the base of transistor Q7. Also connected to the base of transistor Q7, are one end of resistor R13 and capacitor C8, the other end of resistor 13 is grounded and the other end of capacitor C8 connects to one end of resistor R12 and to a pair of jacks 76 in parallel. The wires 62, 63 from the external cords 16 from the drumsticks 12 connect in parallel to the two sides of the jacks 76. The other end of resistor 12 is grounded. The emitter of transistor Q5 connects to the collector of transistor Q4 through resistor R9 and the collector of transistor Q4 is connected to one end of capacitor C9 which couples the drum sound signal to the audio amplifier 74 as explained more fully hereinafter.

The emitter of transistor Q4 is grounded and the base of transistor Q4 connects to one end of resistor R5 by way of resistor R8 and capacitor C3 in series. The other end of resistor R5 connects to one end of resistor R16. The other end of resistor R16 connects to the positive terminal of the battery 36. Resistor R6 connects to the collector of transistor Q3 and at the other end to the junction between resistor R5 and capacitor C3. The emitter of transistor Q3 connects to ground by way of resistor R7 and capacitor C4 in parallel.

The base of transistor Q3 connects to the collector of transistor Q2 and to one end of resistor R4. The other end of resistor R4 connects to the positive terminal of the battery 36 through resistor R16. Resistor R3 connects between the base of transistor Q3 and the base of transistor Q2. Transistor Q2 has a grounded emitter. Transistor Q1 has its base grounded and its emitter connected to the base of transistor Q2 through capacitor C2 and resistor R2 in series. The emitter of transistor Q1 connects through resistor R1 to one end of resistor R4 and the end of resistor R16 away from the positive terminal of battery 36. The collector of the transistor Q1 is floating, that is, not connected.

Capacitor C1 connects between ground and the end of resistor R16 away from the positive battery terminal as does a lead from the jack terminal 76 to which the wires 63 from the drumsticks 12 are connected. As previously stated, the jack terminal is also connected to one end of capacitor C8.

The audio amplifier 74 is conventional in design and needs no further description herein. It is coupled to the drum sound generator 70 by the amplifier input capacitor C9 which connects between the transistor Q5 in an emitter follower circuit arrangement and the resistance in the volume control 28. It should be noted that when the switch 44 in the drumstick 12 closes, as described above by a change in motion, the capacitor C8 becomes connected at one end to the positive voltage $V_{cc}$ through resistor R16, the jack terminal 76, and leads 62, 63 which are shorted together by the closed switch 44. The other end of capacitor C8 is connected to ground through resistor R13. Thus, when the switch 44 in the drumstick 12 is momentarily closed, and it does not matter whether one switch 44 or both is closed since they are in parallel, the capacitor C8 charges momentarily to the voltage $V_{cc}$ to trigger the circuits.

The transistor Q1 and components R1, C2, R2 comprise a white noise generator. The white noise output of this generator is amplified by the transistor circuits Q2, Q3, Q4 with the parallel arrangement of resistor R7 and capacitor C4 forming a filter, limiting the frequency spectrum outputted from the amplifiers. Frequencies above 6000 Hz are substantially attenuated.

When a drumstick 12 strikes a surface or has a sudden change in motion, the switch 44 inside the stick 12 closes and capacitor C8 is momentarily charged to voltage $V_{cc}$. This causes a monostable circuit constructed around transistors Q7 and Q6 to provide an audio pulse output which is shaped by the R-C network C4, R7 to provide a triangular waveform (FIG. 10). The shaped pulse is coupled from emitter follower Q5 to the audio amplifier 74 by way of the amplifier input capacitor C9. This triangularly shaped signal output, limited in frequency by the high pass filter R7, C4, when further amplified in the audio amplifier 74 produces a sound from the loudspeaker 34 which simulates an actual drum. Each actuation of a switch 44 produces another drum sound output. Pulse width in the range of 25 to 100 milliseconds provides an effective drum sound simulator with a preference in the range of 50–60 milliseconds.

In alternative embodiments of a drum sound simulator in accordance with the invention, either or both components R7 and C4 may be variable by the user such that the frequency content of the audio envelope is variable to modify the quality of sound as is pleasing to the user. Any or all of C5, C6, R11 and R12 may be variable by the user in order to change the envelope shape and audible sound quality. In such an instance, one or more tone quality knobs similar to the volume control would be provided as needed on the enclosure 14 where accessible to the user, or screwdriver adjustment may be made available. Variable resistors are preferred over variable capacitors for economic reasons and because of the public's general use and acceptance of such controls on many electrical devices.

In a circuit which gives satisfactory performance, transistors Q1, Q2, Q3, Q4, Q5, Q7, and Q8 are N-type 9014C. Transistors Q6 and Q10 are P-type 9015C and 9012H, respectively. Transistor Q9 is N type 9012H. In microfarads, capacitor C1 is 47, C2 equals 0.01, C3 equals 0.01, C4 equals 0.1, C5 equals 10, C6 equals 1, C7 equals 1000, C8 equals 0.04 and C9 equals 1. In ohms, R1 equals 1 meg, R2 equals 10K, R3 equals 330K, R4 equals 18K, R5 equals 8.2K, R6 equals 2.2K, R7 equals 20K, R8 equals 3.3K, R9 equals 5.6K, R10 equals 2.2K, R11 equals 470, R12 equals 8.2K, R13 equals 10K, R14 equals 1K, R15 equals 1K and R16 equals 220. Commercial quality and tolerances apply to these nominal values.

As stated, audio amplifier 74 is conventional and requires no description herein. Other audio amplifier circuits of conventional type will be suitable to receive the output from coupling capacitor C9.

It should be understood that in an alternative embodiment of a portable drum sound simulator in accordance with the invention, the analog circuits 70, 72 (FIG. 7) can be replaced by a digital synthesizer circuit (not shown) wherein an actual drum sound waveform has been digitized with respect to time in a conventional manner and the drum sound data is stored at separate addresses in memory means, for example, a read only memory. To obtain the digitized data for storage, the drum sound waveform is essentially broken into small time intervals, and a numeric value is assigned to each time interval, which value corresponds to the amplitude of the waveform in that interval. These values are digitized in binary format and stored. When the circuits are triggered by closing the switch 44 in a drumstick 12, the data is read out of the memory addresses in a desired sequence and the binary numbers at each memory address, are converted in a digital to analog converter to an analog signal which is applied to the input of the audio amplifier 74. The data which is originally stored in the memory is preferably derived from an actual drum sound. The elements for this digital sound synthesizer may be mounted on the same printed circuit board 35 in the enclosure 14.

Figure 8:
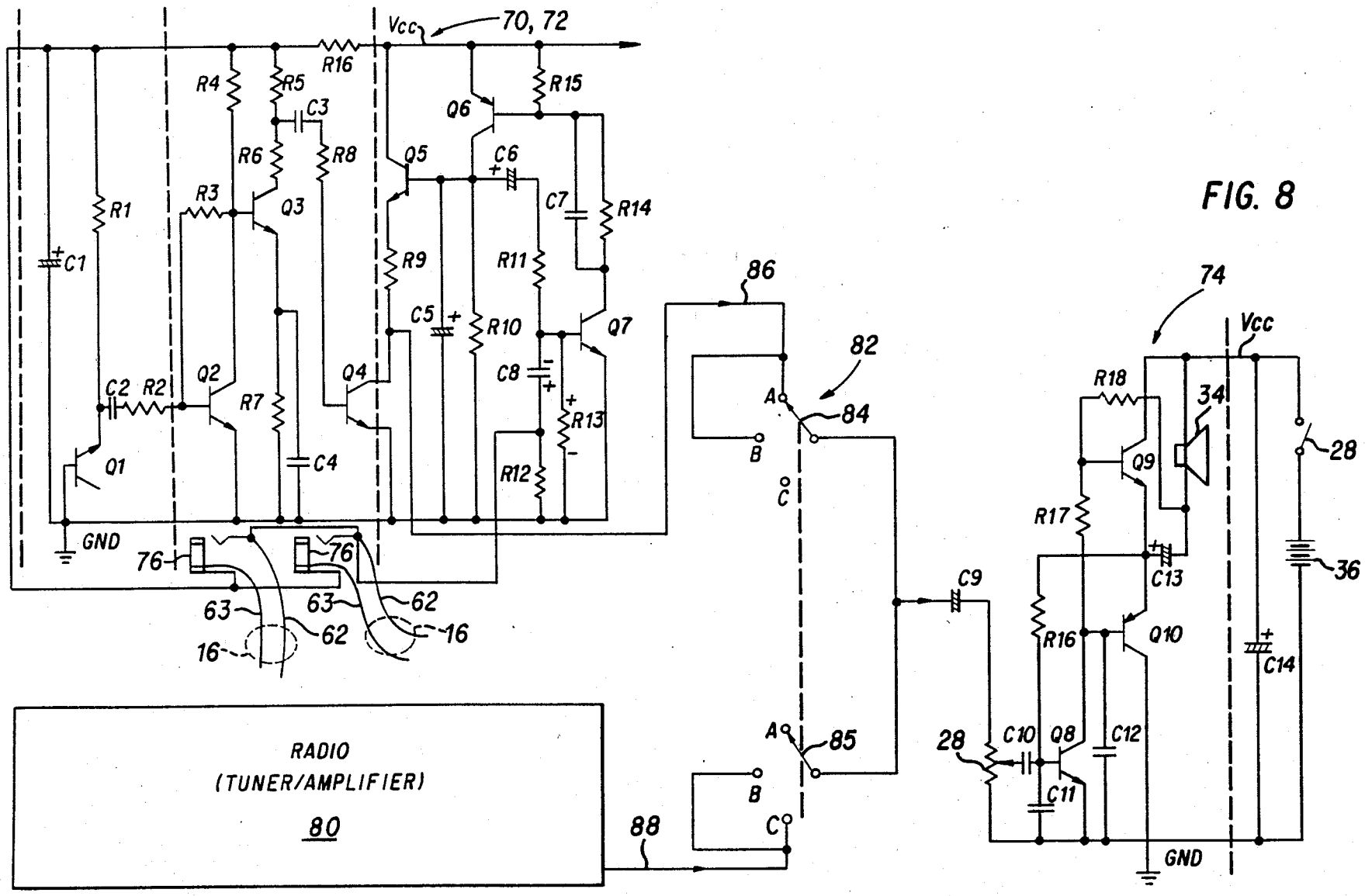
FIG. 8 is an alternative circuit schematic similar to FIG. 7 and including a radio receiver and switching network.

In another alternative embodiment of a portable drum sound simulator in accordance with the invention, as shown in FIG. 8, a radio 80, less its final audio amplification and loudspeaker stages, is combined with a two-pole, three position, ganged mode selector switch 82. Poles 84, 85 of the switch 82 move in synchronism in a conventional manner to selectively make connection with associated contacts a, b, and c of the switch, as illustrated. The output 86 of the sound generator circuits connects to contacts a and b associated with pole 84, whereas the output of the radio 80 connects to contacts b and c associated with the pole 85. The poles 84, 85 are connected in parallel to the input of the audio amplifier 74 at the capacitor C9. Thus, when the poles 84, 85 are at position a, the drum sound generator 70, 72 is connected to the audio amplifier 74, whereas the radio output is blocked. With the poles 84, 85 at position b, the output 86 from the drum sound generator 70, 72 is inputted to the audio amplifier 74 along with the audio output from the radio. Thus, a user of this simulator can accompany the radio sounds with his own drumbeats. With the poles 84, 85 at position c, the drum sound signal generator 70, 72 is blocked from the audio amplifier 74, but the radio output 88 is coupled to the audio amplifier 74 and the user may listen to the radio without any self-generated accompaniment.

The radio circuits, which may be either or both AM and FM, may be incorporated on the printed circuit board 35 with addition of a variable tuning capacitor in the enclosure 14 as is conventional in such radios. The station frequency indicator, that is, a dial, may appear in the enclosure panel 90, as shown in FIG. 1, with a tuning knob similar to the volume control knob 28 also protruding from another opening in the enclosure.

It should be apparent that in alternative embodiments in accordance with the invention, the drum sound generator circuits 70, 72 in FIG. 8, can be replaced with a digital synthesizer operating on internally stored data, as discussed above. The radio 80 may be replaced by an audio cassette player which is accommodated into a modified enclosure 14. Digitized audio tapes are coming on the market and a player for such tapes may be used where the radio 80 is indicated in FIG. 8. Similarly, compact disk players of portable design may be used. All combinations of circuits for drum sound generation with broadcast, stored and recorded music reproduction may be combined in an arrangement as indicated in FIG. 8, where the user can choose between listening to recorded, stored or broadcast music, his own generated drum sounds, or a combination of recorded, stored or broadcast music and his own generated drum sounds.

Also, in alternative embodiments in accordance with the invention, the three-position ganged switch 82 (FIG. 8) may be replaced by a larger switch including more contact positions and/or more poles so that many more functions and combinations may be accommodated. For example, many electronic keyboard instruments now on the market include synthesized rhythm beats, which may be stored in digitized format, or analog. The stored rhythms, for example, waltz, march, jitterbug, etc., can be selectively reproduced audibly while at the same time, the user of the instrument is playing the keyboard which is selectively set to produce one of many instrument sounds. Such a stored rhythm capability can be provided in the enclosure 14 whereby a user of the device can use the drumsticks in conjunction with a prestored rhythm beat just as easily as the radio sound, for example, may be selected for accompaniment as described above. It should also be understood that, with an enlarged switch capability, all of these sound producers may be available to the user in multiple combinations or solo. Thus, the device can include the AM radio, FM radio, stored rhythm capability, audio cassette capability, compact disk capability, etc., etc. All such combinations with the drum sound simulator are considered to fall within the scope of the claimed invention.

Figure 9:
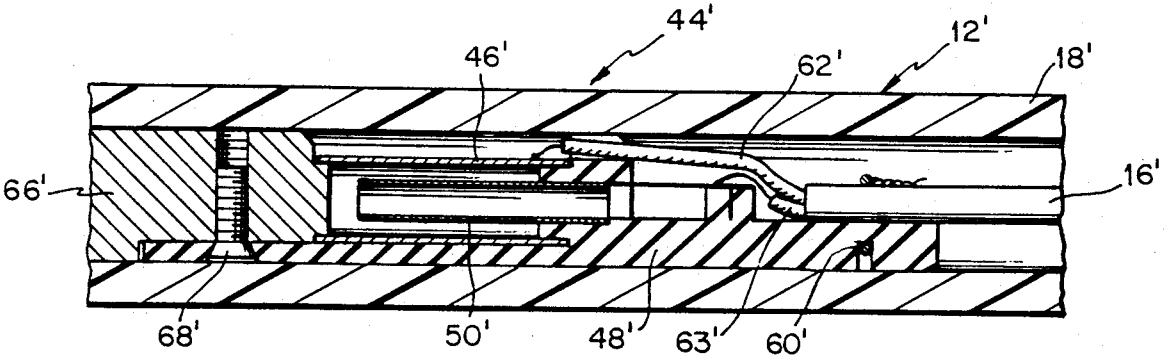
FIG. 9 is a view similar to FIG. 4 showing an alternative embodiment of a switch for incorporation in a drumstick in accordance with the invention.

In an alternative embodiment of a drum sound simulator in accordance with the invention, the trigger switch illustrated in FIG. 9 may be used to replace the trigger switch of FIG. 4. In FIG. 9, the components are functionally the same. However, the coiled spring 50' is mounted within a hollow metal tube 46' concentrically. The spring is suspended as a cantilever such that changes in motion, that is, accelerations, cause the free end of the spring 50' to swing. Whenever contact is made between the spring 50' and the metal tube 46', a circuit which extends through wire 62', 63' to cord 16' is completed. The insulating holder 48' is adapted to support the metal tube 46' and the switch spring 50' in their concentric positions. Either switch 44, 44' can be used in drumsticks 12.

Also in further alternative embodiments in accordance with the invention, the drumsticks can be replaced by other devices, for example, maracas, wherein the pebbles or beans usually contained therein are replaced by a suitably mounted switch 44, 44'. Thus, when the user shakes the maracas, a drum sound is produced from the simulator. Also, the switches 44, 44' can be adapted for attachment to the back of the fingers on each hand of the user, such that the user may slap any surface and produce drum sounds as one would play bongo drums or a tom-tom.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A drum sound simulator comprising, a drum sound generator having an electronic circuit and energizable in response to momentary electrical trigger signals to effect generating of audible drum-like sound outputs each in response to a corresponding trigger signal, two normally open independently activated switches connected to the electronic circuit and momentarily closable for developing the momentary electrical trigger signals for independently effecting energizing of the drum sound generator when momentarily closed and generating the drum-like sound outputs, two drumsticks each mounting a corresponding one of the two independently activated switches and movable in a striking motion in any desired direction at an accelerated velocity and decelerated at a certain rate momentarily at will while moving in said any direction for effectively generating the electrical trigger signals, and each said switch having means for detecting momentary decelerations of the corresponding drumstick and effecting momentary closing of the corresponding switch in response to the detection of the momentary decelerations and effecting generating of the momentary electrical trigger signals.

2. A drum sound simulator according to claim 1, in which said electronic circuit is a digital synthesizer circuit.

3. A drum sound simulator according to claim 1, in which said detection means comprises a deflectable electrical contact deflected in response to a temporary deceleration into a position in which it momentarily closes the corresponding switch and selfrestoring to a position in which it opens the corresponding switch in the absence of a deceleration thereof.

4. A drum sound simulator according to claim 1, in which said drum sound simulator is portable and includes means for suspending the simulator on the body of a user thereof.

5. A portable drum sound simulator comprising, a portable enclosure having therein, a drum sound generator having an electronic circuit and energizable in response to momentary electrical trigger signals to effect generating of audible drum-like sound outputs each in response to a corresponding trigger signal, a portable power source connected in said electronic circuit, at least one normally open, independently activated control switch connected to the electronic circuit and power source momentarily closable for effecting developing of the momentary electrical trigger signals by independently effecting energizing of the drum sound generator when momentarily closed for generating the drum-like sound outputs, at least one drumstick mounting said one independently activated control switch and movable in a striking motion in any desired direction at an accelerated velocity and decelerated by abruptly interrupting said motion momentarily at will while moving in said any direction for effectively controlling generating of the electrical trigger signals, and said control switch having detection means for detecting momentary abrupt decelerations of the corresponding drumstick and effecting momentary closing of the corresponding control switch in response to the detection of the momentary abrupt decelerations and thereby effecting generating of the momentary electrical trigger signals.

6. A portable drum sound simulator according to claim 5, in which said electronic circuit is a digital synthesizer circuit.

7. A portable drum sound simulator according to claim 5, in which said detection means comprises a deflectable electrical contact deflected in response to a temporary abrupt deceleration into a position in which it momentarily closes the corresponding control switch and self-restoring to a position in which it opens the corresponding control switch in the absence of an abrupt deceleration thereof.

8. A portable drum sound simulator according to claim 5, in which said drum sound simulator and includes means for suspending the simulator on the body of a user thereof.

9. A portable drum sound simulator comprising, a drum sound generator having an electrically powered electronic circuit and energizable in response to momentary electrical trigger signals to effect generating of audible drum-like sound outputs each in response to a corresponding trigger signal, two normally open independently activated control switches connected in the electronic circuit and momentarily closable for effecting developing of the momentary electrical trigger signals by independently effecting energizing of the drum sound generator when momentarily closed for generating the drum-like sound outputs, two drumsticks each mounting a corresponding one of the two independently activated control switches and movable in a striking motion in any desired direction at an accelerated velocity and decelerated by abruptly interrupting said motion momentarily at will while moving in said any direction for effectively controlling generating of the electrical trigger signals at any desired point in said striking motion, and each said control switch having means for detecting momentary abrupt decelerations of the corresponding drumstick and effecting momentary closing of the corresponding switch in response to the detection of the momentary abrupt decelerations and thereby effecting generating of the momentary electrical trigger signals.

10. A drum sound simulator according to claim 9, in which said electronic circuit includes a source of music, and means for selectively establishing different modes of generating the drum-like sound outputs solely or in conjunction with music from said source of music.

* * * * *